US006439533B2

(12) United States Patent
Armstrong

(10) Patent No.: US 6,439,533 B2
(45) Date of Patent: Aug. 27, 2002

(54) BOOK DISPLAY METHOD AND APPARATUS

(76) Inventor: Todd Armstrong, P.O. Box 84866, Seattle, WA (US) 98124

( * ) Notice: Subject to any disclaimer, the term of this patent is extended or adjusted under 35 U.S.C. 154(b) by 0 days.

(21) Appl. No.: 09/738,216

(22) Filed: Dec. 15, 2000

Related U.S. Application Data

(60) Provisional application No. 60/172,466, filed on Dec. 17, 1999.

(51) Int. Cl.[7] ..... A47B 23/04
(52) U.S. Cl. ..... 248/447.1
(58) Field of Search ..... 248/444.1, 447.1, 248/447.2, 441.1; 40/792, 4, 611

(56) References Cited

U.S. PATENT DOCUMENTS

| | | | | | |
|---|---|---|---|---|---|
| 2,355,506 | A | | 8/1944 | Brooksbank | |
| 3,789,528 | A | * | 2/1974 | Conell et al. | 40/152 |
| 4,033,652 | A | | 7/1977 | O'Brien | |
| 4,140,296 | A | | 2/1979 | Guzman Guillen | |
| 4,199,125 | A | | 4/1980 | Simon | |
| 4,403,761 | A | | 9/1983 | Jamar | |
| 4,407,523 | A | * | 10/1983 | Campione | 281/46 |
| 4,553,728 | A | * | 11/1985 | Corsello | 248/452 |
| 4,684,099 | A | | 8/1987 | Krapf | |
| 4,993,680 | A | | 2/1991 | Gemmen et al. | |
| 5,259,581 | A | * | 11/1993 | Goldberg | 248/441.1 |
| 5,351,927 | A | * | 10/1994 | Howell | 248/444.1 |
| 5,375,806 | A | * | 12/1994 | Debus et al. | 248/452 |
| 5,445,416 | A | * | 8/1995 | Zareck | 281/42 |
| 5,458,312 | A | * | 10/1995 | Goldberg | 248/444.1 |
| 5,489,079 | A | | 2/1996 | Goldber | |
| 5,580,024 | A | | 12/1996 | Briee | |
| 5,649,683 | A | | 7/1997 | Ahn | |
| 5,829,787 | A | * | 11/1998 | Newhouse, Jr. | 281/46 |
| 6,244,555 | B1 | * | 6/2001 | Benja-Athon | 248/441.1 |
| 6,250,599 | B1 | * | 6/2001 | Goldberg | 248/444.1 |

* cited by examiner

*Primary Examiner*—Ramon O. Ramirez
*Assistant Examiner*—Kofi Schulterbrandt

(57) ABSTRACT

A book display apparatus having a case and a bracket system. The bracket system is adapted to be mounted to a wall and has a connection region and a spring biasing system. The case has an inner surface defining a chamber region adapted to how is a book therein and has a pain system that is adapted to be mounted to the connection region of the bracket system. The spring biasing system is adapted to force the outer surface of the book to the inner surface of the case for proper display.

16 Claims, 9 Drawing Sheets

BOOK DISPLAY METHOD AND APPARATUS

RELATED APPLICATIONS

This application claims priority of U.S. Provisional Application Serial No. 60/172,466, which was filed on Dec. 17, 1999.

FIELD OF THE INVENTION

The invention relates to a method and apparatus of displaying a book. Particularly, the invention allows us an individual to displaying the picturesque or otherwise desirable contents of a book onto a vertical wall.

BACKGROUND

Photographic books or atlas books generally have large photographs contained therein that are aesthetically pleasing to the eye. Many books generally contain numerous photographs, pictures or text that are desirable to display in a public establishment such as a library or in one's own home. Normally, these books containing splendid illustrations remain dormant from public view, closed up without light reflecting their intrinsic beauty to the eye of potential observers. These books remain closed and only display their magnificent contents when they are retrieved from their storage locations and the pages remain briefly open for a short-lived period of time. The walls of an establishment or a home remain bare or contain static images such as paintings or photograph collages that are difficult to store or change.

The present invention remedies these problems of underutilizing the majestic images and brilliant contents contained in various books and naked walls that lack any meaningful semblance. The present invention allows the contents of books to be displayed on a vertical wall for open view. Further, the present invention allows the contents displayed to be dynamic, allowing the proprietor of the book to change the display easily by merely removing the casing from the bracket assembly, retrieving the book from the chamber portion of the casing, turning the book to a desirable page and reinserting the book into the case. Finally, the case is hung back onto the bracket assembly attached to the wall and a new image is presented for all to see.

BACKGROUND ART

A search of the patent literature has a number of patents directed toward these problems, these being the following:

U.S. Pat. No. 5,649,683 Ahn, shows a book holder that is used to hold a book or scratch papers. As seen in FIG. 1, the book holder comprises a memo plate 8 and a contact plate 1. A book can rest on the shelves 9*c* and the vertical protrusions 9*d* hold the pages in place. Memos can be placed on the memo pad 8*b*.

U.S. Pat. No. 5,580,024 Brice, shows and adjustable bracket system which holds a book open to a desired page. As seen in FIG. 1, the book 12 is held open to a page by the front portion 32. FIG. 2 shows a rear, left perspective view of the bookstand where the arms 16 can slide in the direction indicated as 26 to accommodate varying widths of books.

U.S. Pat. No. 5,489,079 Goldber, shows a book holder that is designed to allow for a person lying down to read. The device can hold a book in a side position, and a spring biases the book to the front cover.

U.S. Pat. No. 4,993,680 Gemmen et al., shows a document holder comprises a transparent plate 22 and links 24, that are secured to a support surface 28. The lip 36 supports the lower portion of the documents. As seen in FIG. 4, a book can be placed in the display device where someone raises the transparent plate 22 as it rotates about point 26 (similar to a slider crank).

U.S. Pat. No. 4,684,099 Krapf, shows a magnetic scheduling board that is to be mounted on a wall. Shown in FIG. 3 and 4 is a side view of the board attached to a wall 'W'. The bail 31 rests in hook 52 and the legs 44 can pivot out to engage the wall so the board will be at an incline with respects to the wall. Given the constant width of the frame 24 in FIG. 4, it is not clear how the angle of the board 20 is obtained given the length of the legs 44.

U.S. Pat. No. 4,403,761 Jamar, shows an apparatus for mounting presentation boards. As seen in FIGS. 2 and 3, the leg member 58 engages edge 26 and the board frame 20 rotates clockwise about edge 26 to a position shown in FIG. 3. Support member 56 will come in contact with edge 28 if the board 20 is accidentally bumped. Thus the board will remain attached to the wall unless the board rotates to the position shown in FIG. 2.

U.S. Pat. No. 4,199,125 Simon, shows a device for reading material over a bathtub. As seen in FIG. 3, straps 2 hold a book in place. The movable shield 9 slides through slot 10. The page turning clip 11 can extend through open area 13 to turn pages.

U.S. Pat. No. 4,140,296 Guzman Guillen, shows a book holder that holds a book for reading and has a light to illuminate the pages of the book. The first lever arm 20 is pivotally attached to the fixed pin 16 so the lever arm 20 will rotate in the horizontal plane. The second lever arm 30 is identical to the first lever arm 20 and is attached to the first lever arm by a wing nut assembly 40. As seen in FIG. 5, the book support 45 is attached to the second lever arm 30 and flanges 56 hold the book in place. The light 60 can illuminate the pages of the book.

U.S. Pat. No. 4,033,652 O'Brian, shows a book desk that can be easily removed and stored. As seen in FIG. 3 the book desk 10 hangs from channel strip 31. The prop flap 32 folds out to provide support againsts the wall. As seen in FIG. 6, the edge 34 is adapted to come in contact with the wall the hinge strap 37 allows the prop flap 32 to fold in toward the back cover 25. Then the back covers 25 and 27 fold together about spine 26.

U.S. Pat. No. 2,355,506 Brooksbank, shows a device that hangs on a wall which supports a writing pad.

The prior art fails to show a simplified system having a bracket system and the case where a book can be displayed upon a wall with minimal effort in time. The preferred embodiment of the invention allows an easy removal of the case from the wall and removal of the book contained therein the case in order to display a different page of the book. The prior art fails to show a system where the book desired to be displayed is easily inserted into the chamber region of the case and the case is inserted onto the bracket system and a fluid motion. Further, the prior art fails to show a book display system that can be manufactured with reasonable expense to produce and aesthetically pleasing display apparatus for owners of cherished books. Further, the prior art fails to show a simple spring biasing system that is adapted to force the forward surface of the book to the inner surface of a display case.

SUMMARY OF THE INVENTION

The invention is a book display apparatus has adapted to be mounted to a vertical wall and to display a book that has an outward surface and a rearward surface. The book display apparatus comprises a case that has an upper region, a central region, and a lower region. The case has a hanging system that has a first connector located in the upper region. The first connector has a contact surface described further herein. The case further has a book support system that has a substantially horizontal member with an upper surface thereon that is adapted to support the book. The case has a transparent front section that has an inner surface which is adapted to engage the outer surface of the book.

The book display apparatus further comprises a bracket system having an upper portion. The bracket system comprises a base platform that has a connection region located on the upper portion of the bracket system. The bracket system further has a spring biasing system having a spring member that is adapted to engage the rearward surface of the book to place a forward force thereon.

The first connector of the case is adapted to engage the connecting region of the bracket system and the spring biasing system is adapted to apply forced to the rearward surface of the book in a manner so the outward surface of the book is pressed upon the inner surface of the case.

DETAILED DESCRIPTION OF THE PREFERRED EMBODIMENT

Throughout this description reference is made to top and bottom, front and rear. The device of the present invention can, and will in practice, be in numerous positions and orientations. These orientation terms, such as top and bottom, are obviously used for aiding the description and are not meant to limit the invention to any specific orientation.

Figure 1:
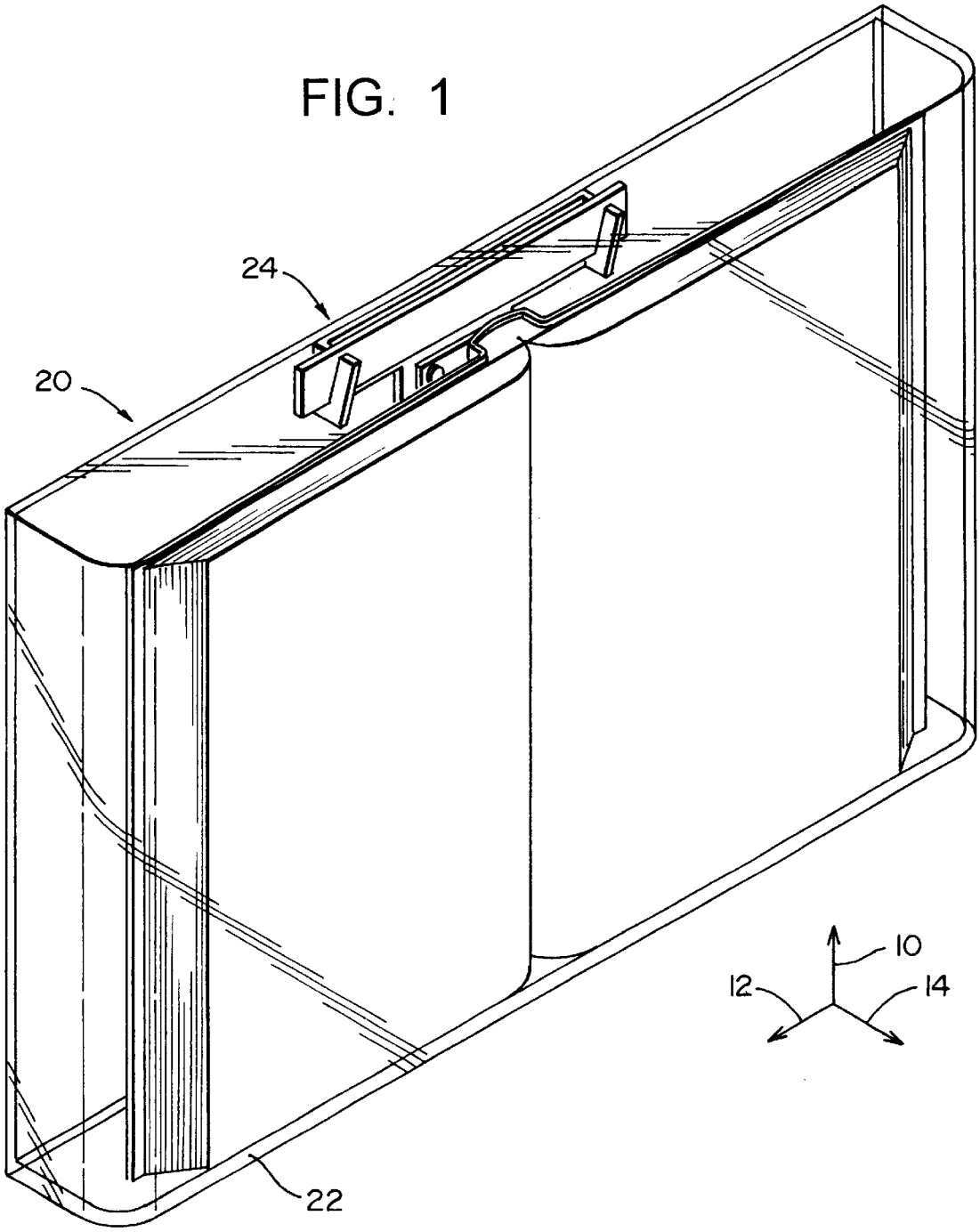
FIG. 1 is an oblique view of the apparatus of the present invention.

There will first be a general description of the overall operations of the apparatus of the present invention followed by a detailed description of the same. As seen in FIG. 1, directions are defined where axis 10 indicates a vertical axis and the arrow of axis 10 indicates an upward direction and a diametrically oppose direction is referred to the downward direction, axis 12 indicates a lateral axis, and axis 14 indicates a transverse axis where the arrow of axis 14 indicates a foreword direction and a diametrically oppose direction is referred to as the rearward direction.

Figure 2:
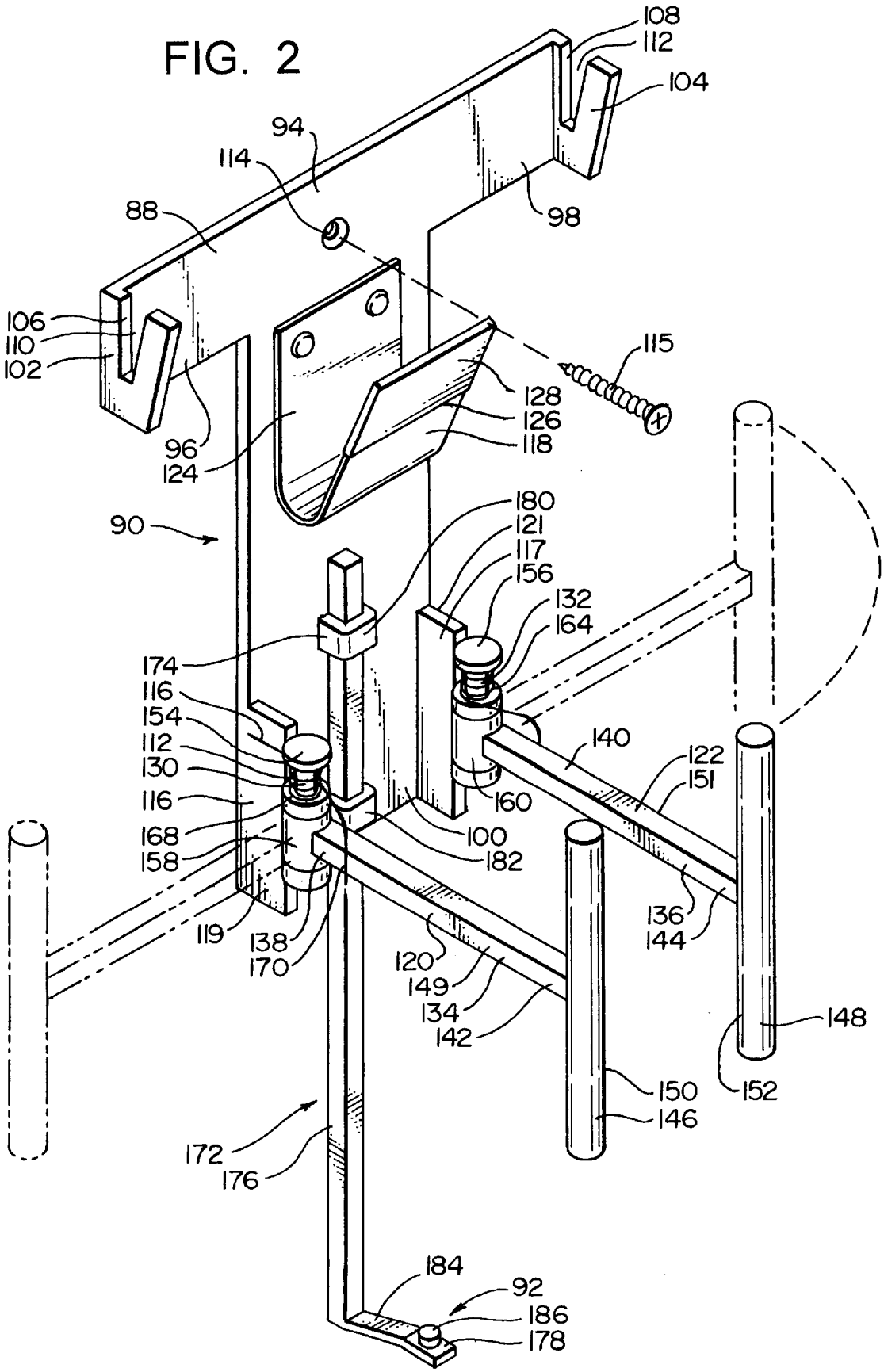
FIG. 2 is an oblique view of the bracket system.
Figure 3:
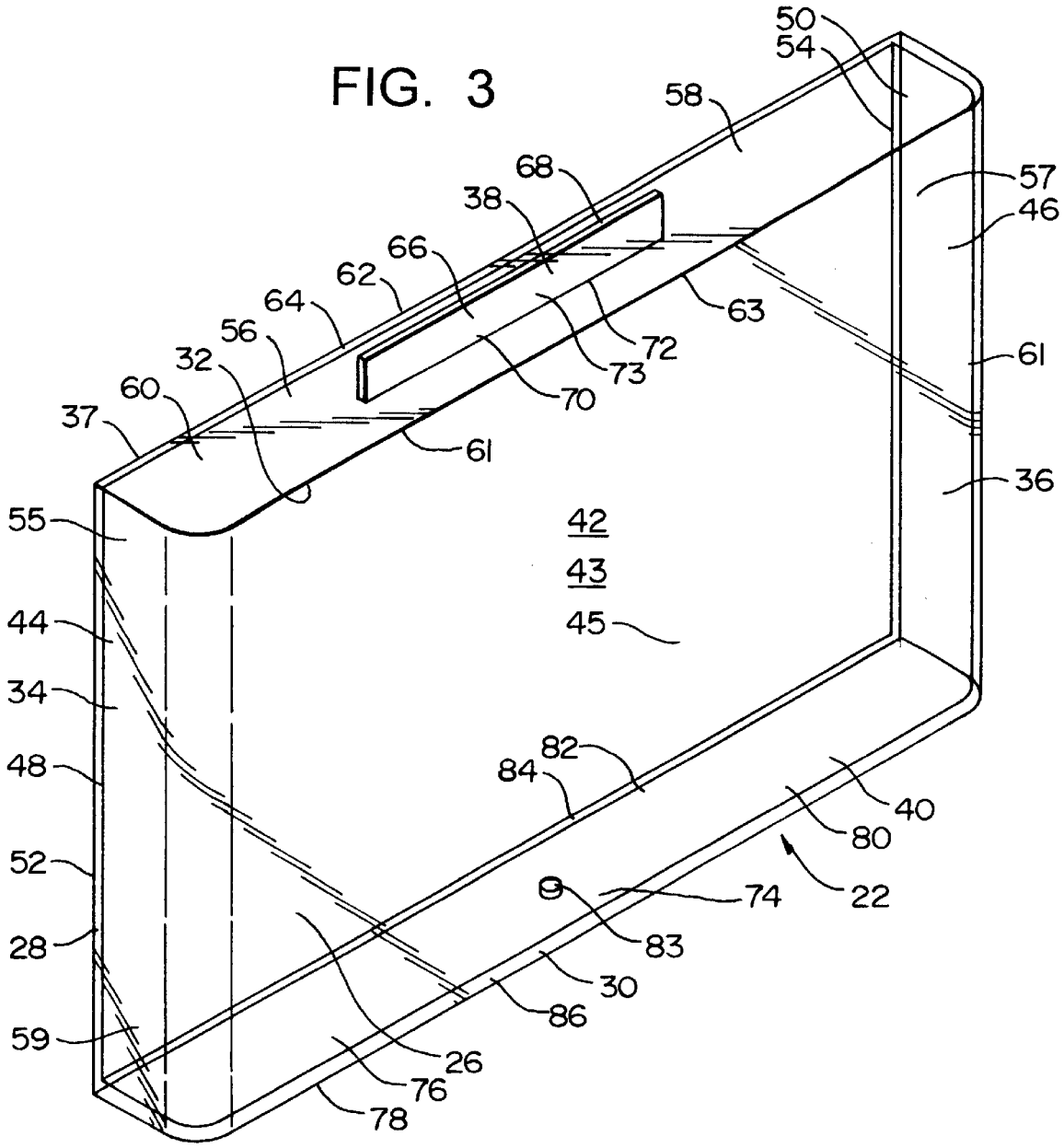
FIG. 3 is an oblique view of the case member.

The general operations of the apparatus of the present invention is as follows. As seen in FIG. 3, the case 22 is a unitary structure that has a rearward open section 37 that provides access to a chamber 39. The user of the apparatus places a book in this chamber portion 39 so that two pages (the outward outward surface) of the book 19 that are desired to be displayed are pressed flush against the inner surface 45 of the case 22. The book rests upon upper surface 76 and front surface 73 and the vertical member 66 helps contain the book therein. Once the book is properly positioned in the case, the book and case arrangements are positioned on a bracketing system that is shown in FIG. 2. The spring biasing system 90 helps to keep the book pressed flush against the inner surface 45 of the case 22 by placing a force upon the rearward surface of the book 19. The slots 110 and 112 are adapted to receive the substantially vertical member (engagement device) 66. The locking mechanism 172 is adapted to be received by hole 83 of case 22 to help maintain the lower portion of the case 22 to rotate outwardly so the book display 20 is in a position as seen in FIG. 1.

There will now be a more thorough discussion of the components of the apparatus of the present invention.

The book display apparatus 20 comprises a case 22 and a bracket system 24. As shown in FIG. 3, the case 22 comprises a front portion 26, a rear portion 28, a lower portion 30, an upper portion 32, a first lateral portion 34 and a second lateral portion 36. The case 22 further comprises a rearward open section 37, a hanging system 38, a chamber 39, and a book support system 40. A transparent front section 42 is positioned in the front portion 26 of the case 22 and has an outer surface 43 and an inner surface 45. The outer surface 43 defines a plane that is orientated to fit in the plane defined by the vertical and lateral axes. As with most of the members of the apparatus, the transparent front section can be made from Plexiglas where the first side section 44 positioned at the first lateral portion 34 and the second side section 46 positioned at the second lateral portion 36 are extensions of the transparent front section 42 where the Plexiglas first and second side sections 44 and 46 our bent ninety degrees in a rearward direction. Alternatively, the case 22 could be created by a plastic injection molding process. The first and second side sections 44 and 46 each have a rearward section 48 and 50 where there is an engagement surface 52 and 54 respectively and each side section has an inner surface 55 and 57, and an outer surface 59 and 61.

Located in the upper portion 32, is an upper substantially horizontal member 56 which has an upper surface 58 and a lower surface 60. A contact surface 62 is located in the rearward section 64 of the substantially horizontal member 56. The upper member 56 further has a front section 61 with a front surface 63 thereon.

The hanging system 38 (or first connector 38) is positioned on the lower surface 60 and comprises a substantially vertical member 66 which has an upper portion 68 and a lower portion 70 with a lower surface 72 thereon. Further, there is a front surface 73 positioned in the front portion of the member 66.

Located in the lower portion 30 of the case 22 is a lower substantially horizontal member 74 which has an upper surface 76 and lower surface 78 a front portion 80 and a rearward portion 82 that has a contact surface 84 thereon. Further, member 74 has a front contact surface 86 which works in conjunction with surface 61 that will be discussed further herein.

The book support system 40 is adapted to receive a book through the rear open portion 37 where the book is open to a page which is desired to be displayed and it is positioned on the upper surface 76 of the lower substantially horizontal member 74.

In a preferred form, the front contact surface 86 and the front surface 63 are positioned in the plane defined by the vertical and lateral plane which is more forward than be plane defined by outer surface 43. Therefore when the case 22 is set down on a flat surface (e.g. a table), the outer surface 43 will not come in contact with the flat surface and therefore outer surface 43 will not be scratched.

The bracket system 24 comprises a base platform 88, a spring biasing system 90 and a locking mechanism 92. The base platform 88 has an upper portion 94, lateral wing portions 96 and 98 and a lower portion 100. Located on the lateral wing portions 96 and 98, are support members 102 and 104 which extend outwardly and each have a surface 106 and 108 that define slots 110 and 112. Located in the central portion of the base platform 88 is a surface 114 that defines a hole that is adapted to allow a screw 115 to pass therethrough. The base platform is designed to be mounted permanently on a wall or vertical surface.

Located in the lower portion 100 of the base platform 88 are vertical members 116 and 117 each comprise a laterally outward surface 119 and 121. The vertical members 116 and 117 are rigidly attached to the base platform 88 and laterally outward surfaces 119 and 121 provide a support platform for springs 162 and 164 discussed further herein.

The spring biasing system 90 comprises a spine biasing spring 118, a first torsion biasing spring 120 and a second torsion biasing spring 122 (or referred to as torsion spring assemblies). The spine biasing spring 118 is a V-shaped leaf spring which has a base portion 124 and an extension portion 126 which has a contact surface 128. The torsion spring assemblies 120 and 122 each comprise torsion members 130 and 132 and a T-frame 134 and 136 which have a radially inward end 138 and 140 and a radially outward end 142 and 144. The vertical members 146 and 148 are rigidly attached to the radially outward ends 142 and 144 and have a book cover contact surface 150 and 152 and a spring contact surface 149 and 151. Located at the radially inward ends are the torsion members 130 and 132 that each comprise vertical circular rods 154 and 156, cylinder portions 158 and 160, and springs 162 and 164. The springs 162 and 164 are substantially similar therefore spring 162 will be only further described with the understanding the description is applicable to spring 164. Spring 162 has a first member 166 a spiral base portion 168 and a second member 170. The first member 166 exerts a force on surface 119 of vertical member 116 and a second member 170 of spring 162 exerts the force on lateral surface 149 of the T-frame 134. Therefore, when the T-frame 134 is in the position shown as the broken lines in FIG. 2, the spring 162 will bias it to the position of the T-frame 134 as shown with the solid lines in FIG. 2.

The locking mechanism 172 comprises a vertical adjustment portion 174, a stem portion 176 and a locking member 178. The adjustment portion 174 comprises two bracket members 180 and 182 which are each rigidly attached to the central portion of the base frame 88 and each have an inner surface that define a passage to allow stem portion 176 to pass therethrough. In a preferred form, the clearance between the inner surface of the bracket members 180 and 182 and a stem portion 176 is minimal so the stem portion 176 is frictionally engaged therein so the stem member 176 will not move in a downward direction when subjected to gravitational forces. Located in the lower portion of the vertical stem is a locking member 178 which extends outwardly in the transverse direction and has an upper surface 184 which defines a protrusion 186 which is adapted to be received by the hole 83 in the lower portion of the case 22.

Figure 5:
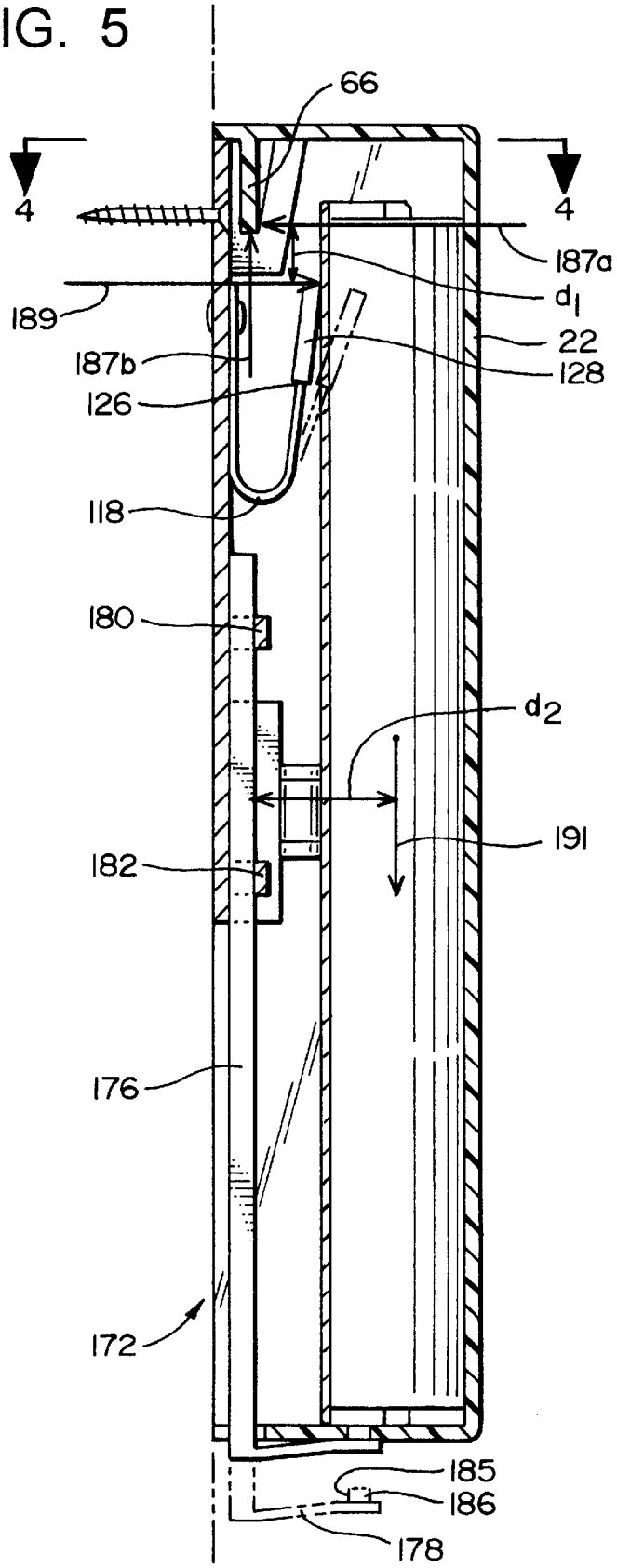
FIG. 5 is a vertical cross-sectional view taken at line 5—5 in FIG. 4.

As seen in FIG. 5, the spine biasing spring 118 is deflected from a resting position which is shown as a broken line, to a deflected position shown by the solid line where the extension portion 126 is biased rearwardly when the spine of the book exerts force on the contact surface 128. The locking mechanism 172 helps prevent the case from rotating counterclockwise as seen in FIG. 5 by having the stem portion 176 extend through the bracket members 180 and 182 where the stem member is frictionally engaged therein. When the case 22 is in the position shown in FIG. 5, locking member 178 is raised vertically from where it is shown as a broken line to where it is shown as a solid line where the extension 186 is positioned in the hole 83 of the case 22. Thus the inward portion 185 of surface 186 will supply a force in hole 83 to prevent counterclockwise rotation of the case 22.

Alternately, the locking mechanism 172 need not be employed with proper positioning of the spine biasing spring 118. A detailed force vector analysis is more thoroughly described below.

When the substantially vertical member 66 of the case 22 is positioned in the slots 110 and 112, the outward portion of the surfaces 106 and 108 exerts a force upon the substantially vertical member 66 as indicated by vectors 187*a* and 187*b*. Likewise the forces of the contact surface 128 upon the spine of the book is indicated by vector 189. The center of gravity of the case 22 and the book contained therein is dependent upon the weight and size of the book; however, an approximate value is indicated by vector 191 where the magnitude of this vector is equal to that of 187*b*. Therefore, for the case 22 to remain in a static position as shown in FIG. 5 without a the use of the locking mechanism 172, the magnitude of vector 191 times distance d2 (clockwise moment) must be equal or greater to distance d1 multiplied by vector 189 (counterclockwise moment). Therefore, when the spine biasing spring 118 is positioned in a more vertically upward position with respect to the slots 110 and 112, the distance d1 is decreased and thus decreases the counterclockwise moment. Likewise, the stiffness as the spine biasing spring 118 can be decreased yet have sufficient force in the outward traverse direction to sufficiently press the spine of the book towards the inner surface 45 of the case 22. Some distances that have been found to be effective for d1 are 0.5" to 3" with spring constants of 2 lbs. per inch to 8 lbs. per inch and d2 has been found to be effective at ranges of 0.5 inches to 4 inches.

Figure 4:
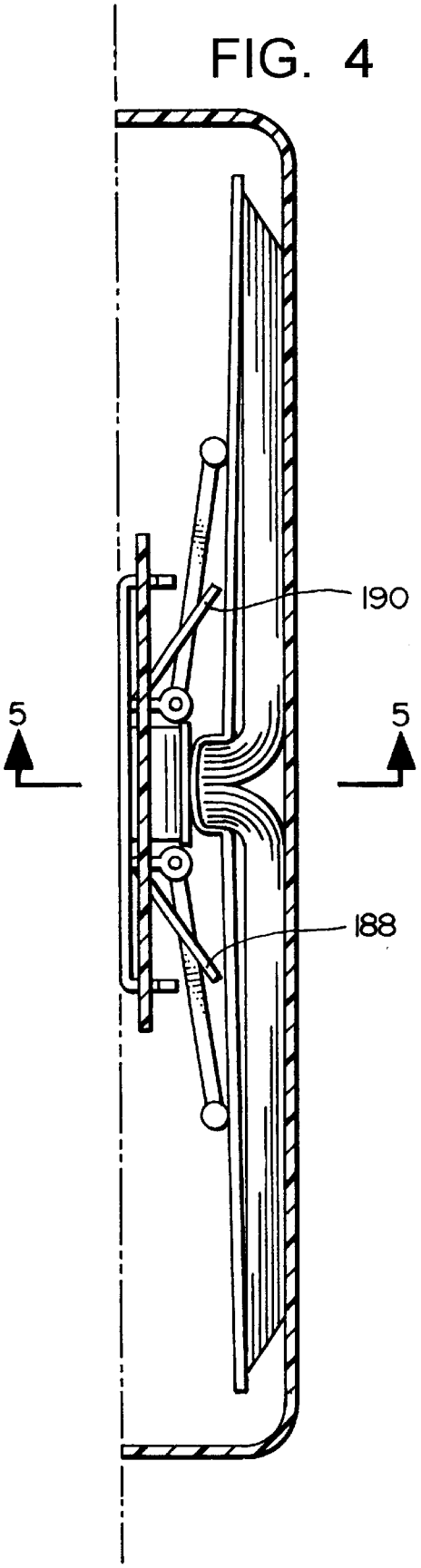
FIG. 4 is a horizontal cross-sectional view of a second embodiment of the apparatus taken at line 4—4 in FIG. 5.
Figure 4A:
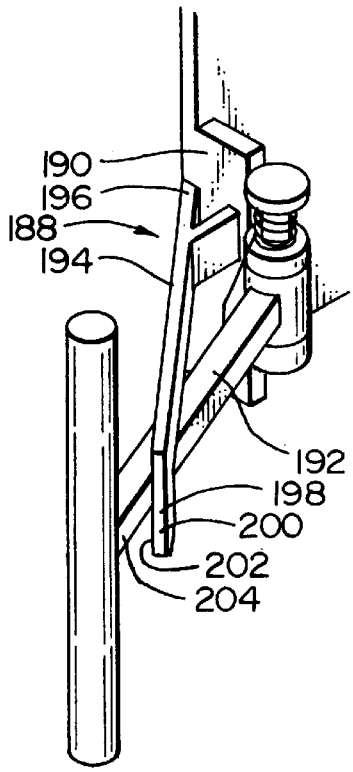
FIG. 4*a* is an oblique view of a stop system of the second embodiment of the bracket system.

As seen in FIG. 4, there is a second embodiment where a stop is used that prevents the T-frames 134 and 136 from rotating to the inward position shown in FIG. 2. A more desirable maximum inward rotation would be about 30 degrees from the lateral direction. FIG. 4 shows a top view of the second embodiment and FIG. 4*a* shows an oblique view of the same where the main difference in this embodiment from the first embodiment of the bracket system is the addition of the stop system 188 and 190 that both operate in the same manner therefore system 188 will only be described in detail with the understanding that the description is applicable to stop system 190. As seen in FIG. 4*a*, there is a vertical member 191 and a base portion of T-member 192. Located on the outward face of the vertical member 190 is extension 194 that has a base portions 196 and an outward portion 198. The base-portion 196 is rigidly attached to the vertical member 191 and extends above the T-member 192. Likewise it could extend below the T-member 192 as long as it remains out of the way of the horizontal path of travel of the T-member 192. Located on the outward portion 198 is a vertical member 200 that extends downwardly and has an inner contact surface 202 which engages the outer contact surface 204 of the T-member 192. This prevents the T-member 192 from undesirably rotating too far to the front inward portion of the bracket system 24.

Figure 6:
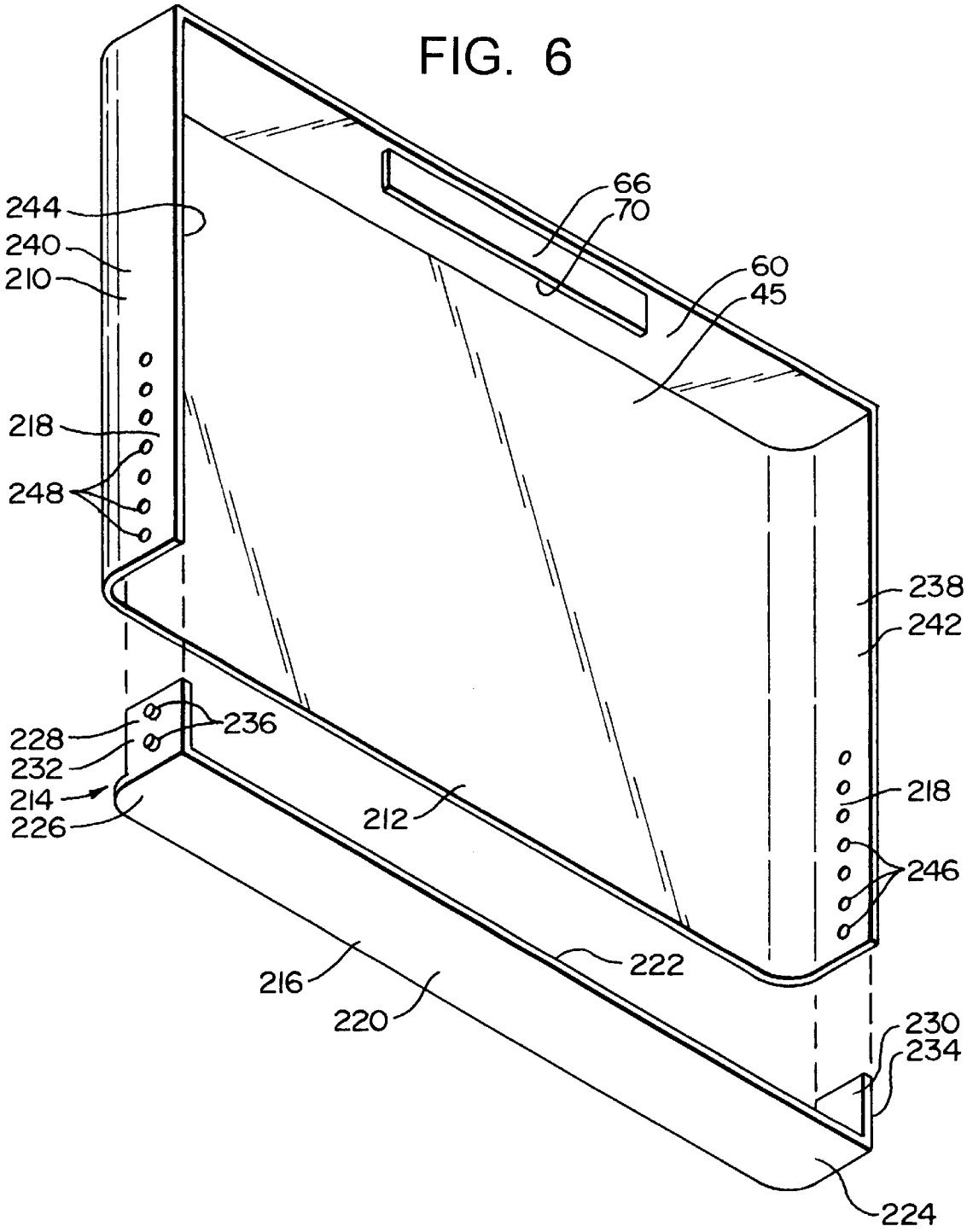
FIG. 6 is an oblique view of a second embodiment of the case taken at a rearward and upward perspective.

FIG. 6 is a second embodiment of the case 22 taken from the perspective of a rearward and lower observer. This embodiment allows for multiple sized books to be used with one case.

The case 210 is substantially similar to the case 22 as shown in FIG. 3, except located in the lower portion 212 of case 210 is a vertical adjustment system 214 that comprises a horizontal member 216 and a receiving system 218. Similar to the first embodiment, the case 210 in the third embodiment has a lower surface 60, a substantially vertical member 66 that has a front surface 70, and an inner surface 45.

The substantially horizontal member 216 has a lower surface 220, an upper surface 222, a first end portion 224 and a second end portion 226 where there are located vertical extensions 228 and 230 that have an outer surface 232 and 234 which define lateral extending protrusions 236.

The receiving system 218 comprises a first side section 238 and a second side section 240 that each have an inner surface 242 and 244 which define a plurality of adjustment holes 246 and 248.

Figure 7:
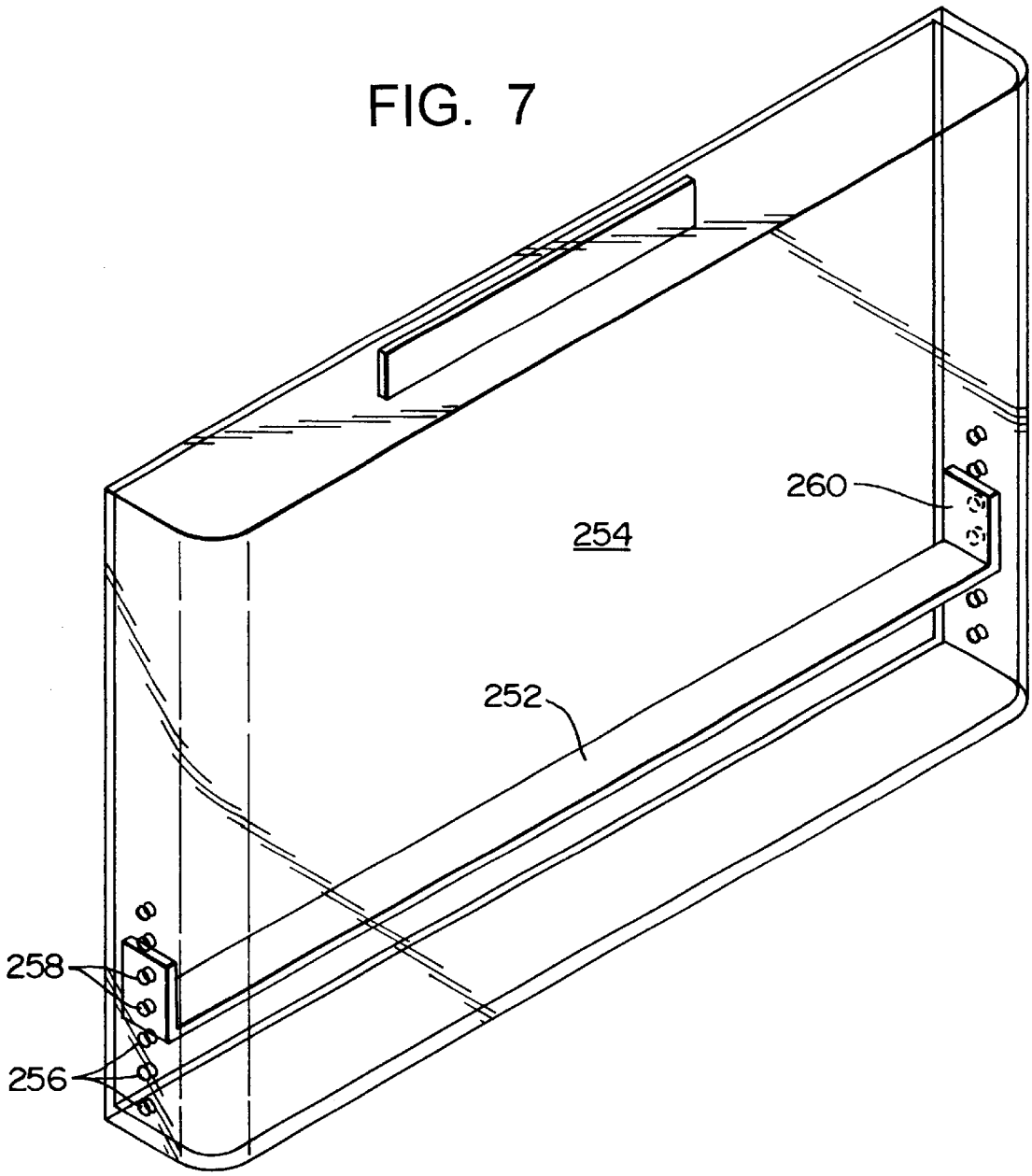
FIG. 7 is an oblique view of a third embodiment of the case taken at a rearward and upward perspective.

The case 250 as seen in FIG. 7 is a combination of the first two embodiments of the present invention where the case 250 is essentially the same case as seen in FIG. 3; however, the substantially horizontal member 252 is housed in the chamber portion 254 of the case 250. The adjustment holes 256 are adapted to receive the protrusions 258 that are located on the vertical extensions 260 of the substantially horizontal member 252.

In operation, the user of the apparatus of the present invention will judge the height of a book (i.e. length of the spine) and adjust the vertical adjustment system 214 so the distance between the lower surface 60 of the case 210 and the upper surface 222 of the substantially horizontal member 216 is a little bit greater than the height of the book to be placed therein. This adjustment is accomplished by taking advantage of the flexible properties of the first and second side sections 238 and 240 and bending them laterally outwardly and then positioning the substantially horizontal member 216 in the lower portion of the case 210 so the protrusions 236 fits into the corresponding holes 248 so a desirable vertical distance between surfaces 222 and 60 is obtained. From this point forward, the case 210 can be used in a substantially similar manner as in the first embodiment, where a book is opened to a desirable pair of pages to be displayed and this book is placed where the two pages face outwardly and are positioned next to surface 45 of case 210. Then the case 210, with the book positioned therein, is positioned on a mounting bracket where the substantially vertical member 66 is positioned in the slots 110 and 112 as described supra.

Figure 8:
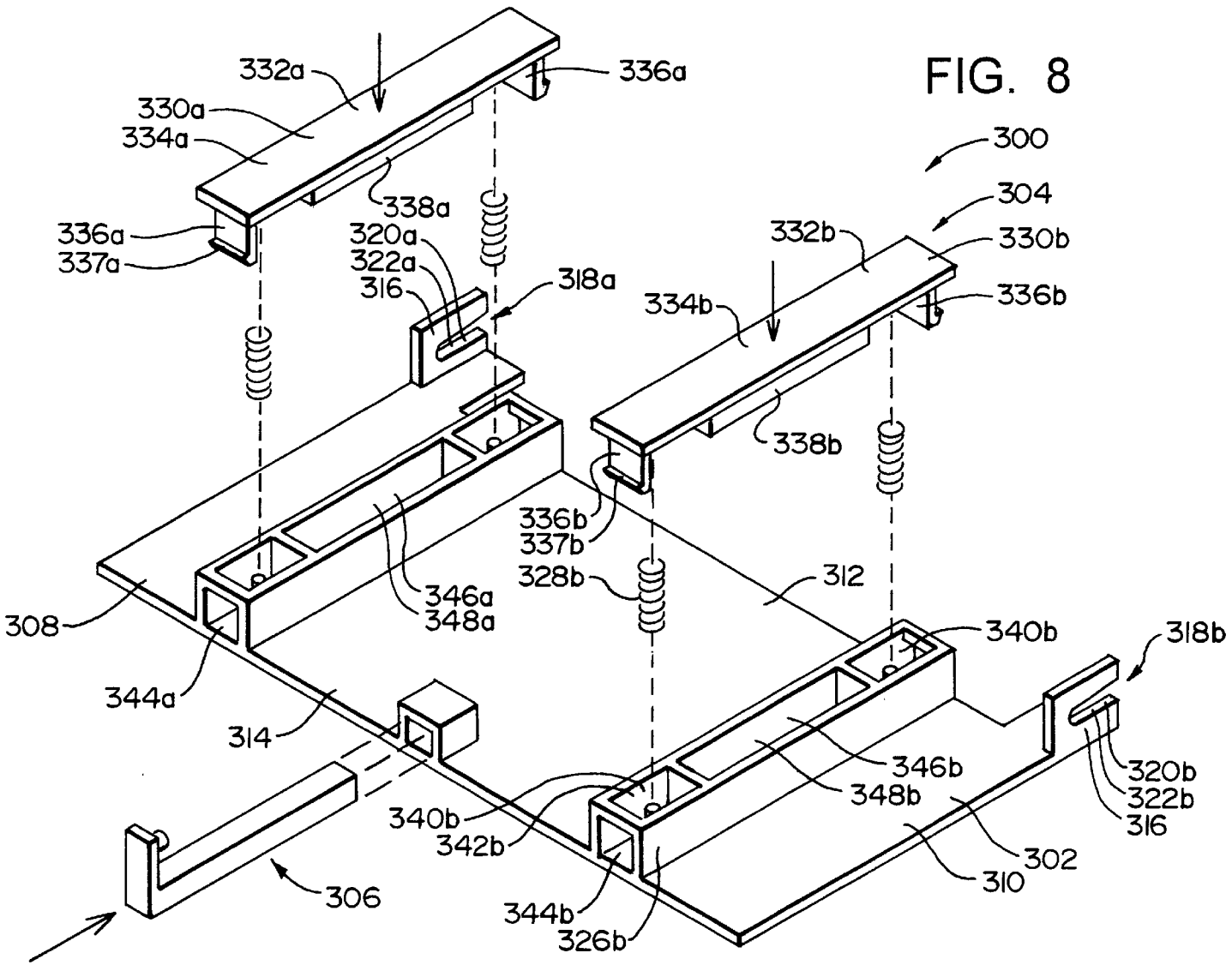
FIG. 8 is an oblique view taken from a lower and rightward perspective of a third embodiment of the bracketing system.

FIG. 8 shows a second embodiment of a bracket system 300 that comprises a base platform 302, a spring system 304, and a locking mechanism 306. The base platform 302 has a first side portion 308, a second side portion 310, an upper portion 312, and a lower portion 314. Located in the upper portion 312 is a hanging assembly 316 which comprises a first hanging member 318 a and a second hanging member 318*b*. The hanging members 318 have surfaces 320 which define slots 322 that are adapted to receive a substantially vertical member 66 of the case 22.

Located on the first and second side portions 308 and 310 are the spring members 324 which comprises a fitted slot portions 326, spring components 328, and members 330. The members 330 each have a book contact portion 332 that each has a book contact surface 334 thereon, a locking mechanism 336, and a guide member 338. The fitted slot portions 326 each have a first surface 340 which defines a cavity 342 which is adapted to receive the springs 328. The first surface 340 further defines an open portion 344 which is adapted to receive the locking mechanism 336 which keeps the member 330 inseparable from the base platform 302. The fitted slot portions 326 further each have a second surface 346 which defines a second cavity 348 that is adapted to receive the guide member 338. The guide members 338 are tightly fitted within the chamber 348 so the member 330 will travel substantially in the transverse direction.

It should be noted that using an injection molding process could produce the case 22 and the bracketing member 300. Assembly of the case 300 is accomplished as seen in FIG. 8 where the springs 328 are positioned in the cavities 342 and the members 330 are positioned inwardly so the locking members 336 engage the open portions 344 and the outward surface 337 will engage the upper surface of the open portion 344.

The hanging system which operates to mount the case 22 onto the bracketing member 24, and the spring assemblies that operate to bias the book forward, are shown for exemplary purposes where it is understood that other methods of hanging the case to the bracket system and biasing the book forward to the inner surface of the case could be employed without departing from the spirit and scope of the invention.

Figure 9:
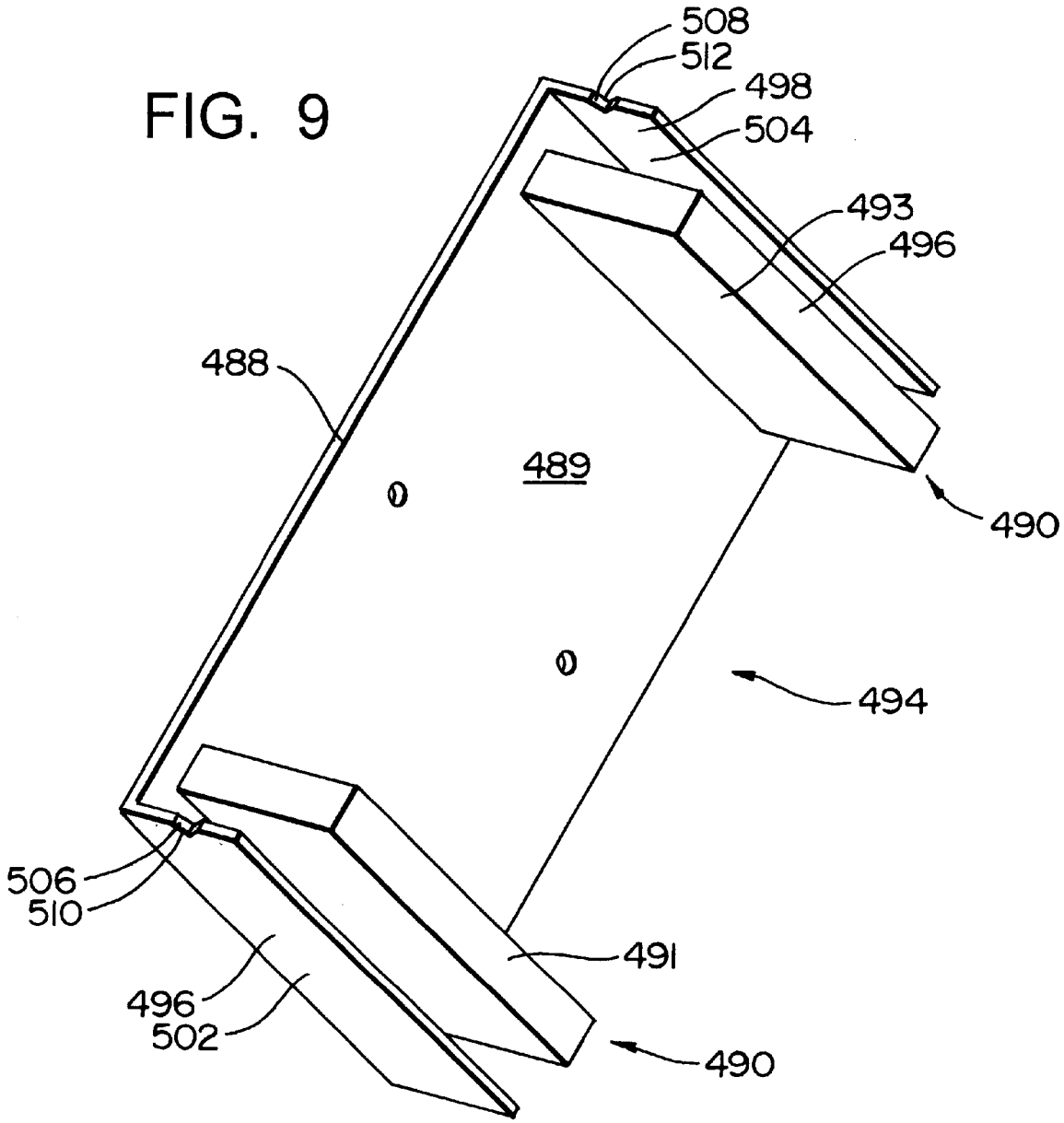
FIG. 9 is an oblique view of a fourth embodiment where the spring biasing system comprises foam sections.

FIG. 9 shows a fourth embodiment of the present invention where the bracketing system 424 comprises a base platform 488 and a spring biasing system 490. The base platform 488 has an upper portion 494, lateral wing portions 496 and 498 and a forward surface 489. Support members numeral 502 and 504 are located in the lateral wing portions 496 and 498 respectively, and extending outwardly. Surfaces 506 and 508 defined slots 510 and 512 that are adapted to receive the first connector 38 of the case 22.

The spring biasing system 490 in the fourth embodiment comprises a first foam section 491 and a second foam section 493. The foam sections have an outward surface in the transverse direction indicated at 495 and 496. The surfaces 495 and 496 are adapted to engage the rearward surface of a book and apply a force thereto. Further, the surfaces 495 and 496 can be displaced rearwardly in the transverse direction when pressure is placed thereon in the rearward direction. Of course the pressure applied to the rearward surface of the book multiplied the by the surface area of surfaces 495 and 496 results in a force applied thereto. The foam sections 491 and 493 can be glued to the forward surface 489 of the base platform 488. The foam has compressive properties where the load bearing capacity is such that the moderate pressure exerted from the book 19 in the case 22 deflect the surfaces 495 and 496 rearwardly to create a force thereon. The net spring rating of the foam is desirable to be between 0.5 lb. per inch of deflection to 10 pounds per inch of deflection. A more desirable range of net spring rating of the foam sections 491 and 493 are 1 lb. per inch of rearward transverse deflection to 5 lb. of force per inch of rearward deflection.

The novel features of the present invention are to have two main components, a wall bracket and a transparent case, where the wall bracket is positioned on a wall and the case is adapted to hold a book and be mounted on the wall bracket so that two adjacent pages of the book are displayed. In a desirable form, spring members are employed to impress the pages on the inner surface of the case. Further, the case can be easily removed and repositioned on the wall bracket with little difficulty.

It should be noted that the outward surface of the book 19 could be the cover of the book in a display method where the book 19 is closed. It should further be noted that the force to apply the book to the inner surface 45 of the transparent front section 42 can be very low (0.5–3 pounds) to achieve a proper positioning of the book 19, of course the force is not limited to any range in the broader scope of the invention.

While the invention is susceptible of various modifications and alternative forms, specific embodiments thereof have been shown by way of example in the drawings and will herein be described in detail. It s should be understood, however, that it is not intended to limit the invention to the particular forms disclosed, but, on the contrary, the intention is to cover all modifications, equivalents and alternatives falling within the spirit and scope of the invention as expressed in the appended claims.

I claim:

1. A book display apparatus to display a book at a wall location, said apparatus comprising a separate case component in which the book can be positioned, and a separate bracket component which can be connected to a wall member and to which the case component can be mounted in a book display position on the wall member, said apparatus comprising:

a) said case component having a generally planar transparent front panel through which the book can be viewed, and at least upper and lower perimeter members connected to, respectively, upper and lower perimeter portions of the front panel and extending rearwardly therefrom, said front panel and said two perimeter portions collectively defining a book-receiving region having vertical and lateral dimensions sufficiently large to enable a book to be positioned therein in a display location adjacent to the front panel;

b) said bracket component comprising:

i. a base member having a connecting portion by which the bracket component can be connected to a wall member;

ii. a biasing section to engage the book and urge the book in a forward direction;

c) a mounting system comprising a case-mounting portion of the case component and a bracket mounting portion of the bracket component, which mounting portions are arranged to engage one another in mounting relationship by which, with the bracket component connected to the wall member, the case component is able to be removably mounted to the bracket component in said book display position adjacent to the wall member;

d) said case component being arranged in a manner that a rear portion of the case component has, at a location immediately rearwardly of the book-receiving region, a substantially open rear area, so that with the case component removed from its book display position where it is mounted to the wall member, the book can be moved through the rear open area of the chamber component into or from its display location in the book-receiving region;

e) said case component and said bracket component also being arranged so that with the bracket component being connected to the wall member, and with the book positioned in the display location in the case component, the case component with the book therein can be moved to the bracket component, with the two mounting portions coming into mounting relationship to support the book component positioned in the book display position, with the book being supported by the lower perimeter member of the case component and with the book being positioned to be urged forward by the biasing section of the bracket component to be adjacent to the front panel.

2. The apparatus as recited in claim 1, wherein said case component comprises two oppositely positioned side perimeter members connected to opposite sides of side perimeter portions of the front panel, said upper, lower, and side perimeter portions collectively providing a surrounding perimeter enclosure for the book-receiving region.

3. The apparatus as recited in claim 1, wherein the upper and lower perimeter portions each have a forwardly extending edge portion which extends further forward than a forward surface of the front panel, whereby the case component can be positioned on a surface with a forward surface of the front panel facing downwardly and the substantially open rear area of the case component is facing upwardly and exposed to permit the book to be easily positioned in the book-receiving region, after which the case component with the book therein can readily be mounted to the bracket component.

4. The apparatus as recited in claim 3, wherein the mounting system comprises a recess-and-protrusion mounting configuration where one of the case-mounting portion and the bracket-mounting portion is formed with a recess configuration, and the other of the case-mounting portion and the bracket-mounting portion comprises a protrusion configuration fitting in the recess configuration.

5. The apparatus as recited in claim 4, wherein said mounting system comprises at least two laterally spaced recess portions and two laterally spaced protrusion portions coming into engagement with one another, and positioned on opposite sides of a center of gravity of the case component with the book therein.

6. The method as recited in claim 5, wherein the case-mounting portion comprises a downwardly extending edge member connected to the upper perimeter member of the case component, and the bracket-mounting portion comprises a pair of laterally spaced mounting members formed with laterally aligned recesses.

7. The apparatus as recited in claim 1, wherein the connecting portion of the base section comprises a connecting plate having at least one through opening through which a connecting member can be inserted to mount the bracket component to the wall member.

8. The apparatus as recited in claim 7, wherein the connecting portion of the base member as an upper location, and there are two laterally spaced forwardly extending mounting members extending forwardly from the base connecting member to be positioned for mounting of the case component thereto.

9. The apparatus as recited in claim 1, wherein said biasing section comprises a compressible resistant section positioned to engage the book in its book display position.

10. The apparatus as recited in claim 1, wherein said biasing section comprises a pair of laterally spaced biasing members, which are made of a resilient compressible foam material and which have forward surfaces positioned to engage the book when the case component with the book therein is brought into mounting engagement with the bracket component, with the book being moved into engagement with the biasing members and compressing the biasing members so that the book is properly positioned adjacent to the front panel.

11. The apparatus as recited in claim 10, wherein said biasing members are made of a resilient plastic foam material.

12. The apparatus as recited in claim 1, wherein said biasing section comprises two laterally spaced contact members, each having a forwardly facing contact surface to engage the book, and further comprising spring members connected to the contact plates and mounted to the bracket component to urge the contact plate forwardly into a book-engaging position.

13. The apparatus as recited in claim 11, wherein said biasing section comprises at least one spring member.

14. The method as recited in claim 13, wherein said spring member comprises at least one compression coil spring.

15. The apparatus as recited in claim 13, wherein said spring member comprises at least a mounting plate connected to the base section and a spring arm member having an edge connection to the base member and is yieldingly deflected by being deflected along its connecting axis.

16. The apparatus as recited in claim 1, wherein said case component with the book therein has a center of gravity is positioned forwardly from and below a support location at which the case component is supported in a manner so that a moment is produced that forces the front panel of the book against the biasing system.

* * * * *